US006551075B2

(12) United States Patent
Gabrieli et al.

(10) Patent No.: US 6,551,075 B2
(45) Date of Patent: Apr. 22, 2003

(54) MAGNET PUMP WITH BI-DIRECTIONAL AXIAL SELF-ALIGNMENT

(75) Inventors: Omar Gabrieli, Brescia (IT); Francesco Gennari, Castel Mella (IT)

(73) Assignee: Argal S.r.l., Brescia (IT)

( * ) Notice: Subject to any disclaimer, the term of this patent is extended or adjusted under 35 U.S.C. 154(b) by 0 days.

(21) Appl. No.: 09/837,527

(22) Filed: Apr. 18, 2001

(65) Prior Publication Data

US 2002/0028147 A1 Mar. 7, 2002

(30) Foreign Application Priority Data

May 5, 2000 (EP) ..... 00830326

(51) Int. Cl.[7] ..... F04B 17/00
(52) U.S. Cl. ..... 417/365; 417/420; 417/423.1
(58) Field of Search ..... 417/365, 420, 417/423.1, 423.15

(56) References Cited

U.S. PATENT DOCUMENTS 3,610,974 A * 10/1971 Kenyon ..... 310/49
4,722,661 A * 2/1988 Mizuno ..... 417/360
5,041,419 A * 8/1991 Leupold ..... 505/1
5,154,587 A * 10/1992 Mori et al. ..... 417/420
5,168,186 A * 12/1992 Yashiro ..... 310/47
5,324,177 A * 6/1994 Golding et al. ..... 417/423.1
5,332,374 A 7/1994 Kricker et al. ..... 417/420
5,493,161 A * 2/1996 Uno et al. ..... 310/156

FOREIGN PATENT DOCUMENTS

GB 1134228 11/1968 ..... H02K/49/10
JP 07035086 A * 2/1995
WO WO9619034 6/1996 ..... H02K/49/00
WO WO9804834 2/1998 ..... F04D/13/02

* cited by examiner

*Primary Examiner*—Charles G. Freay
*Assistant Examiner*—John F Belena
(74) *Attorney, Agent, or Firm*—Abelman, Frayne & Schwab

(57) ABSTRACT

A magnet pump with bi-directional axial self-alignment comprises an inner chamber (12), provided with a suction duct (13) and a delivery duct (14); an impeller (25) located in said chamber (12) in a rotatably and axially movable manner, and having, a front portion (26) oriented towards the suction duct (13); a driven rotor (31) integral with the motor spindle (51), located outside said chamber (12) and bearing magnets (34) cooperating with as many driven magnets (35) facing the same, located in the rear portion (27) of impeller (25), and a magnet (41) fixed in the inside of said chamber (12) and cooperating with a second magnet (42), incorporated in said impeller (25) so as to realize a linear magnetic coupling.

8 Claims, 3 Drawing Sheets

MAGNET PUMP WITH BI-DIRECTIONAL AXIAL SELF-ALIGNMENT

FIELD OF THE INVENTION

The present invention relates to a magnet pump with bi-directional axial self-alignment. More particularly, the present invention relates to a magnetic entraining pump suitable to support and counterbalance axial thrusts in both directions and to keep the impeller in the exact position even in extreme or abnormal operating, conditions.

BACKGROUND OF THE INVENTION

Magnet pumps are commercially well known and described in the literature, such as for instance in British Patent No. 1,134,228. Magnet pumps are typically centrifugal, one-step pumps, with a preferably closed impeller and are employed in liquid pumping, including in chemical and corrosive applications, in water purification and recovery, and in conjunction with heat exchangers, sea water desalination plants, etc.

Generally, magnet pumps include an inner chamber having, a suction duct that extends axially and a delivery duct that extends circumferentially; an impeller located inside of the chamber so as to be capable of rotating therein, and possibly translating axially. The impeller has a front side, oriented towards the suction duct, and a rear side, oriented in the opposite direction; a driving rotor, located outside the chamber, fixed to a motor spindle and provided with driving magnets; a driven rotor, fixed to the impeller and provided with driven magnets that face onto, and form a magnet coupling with, the driving magnets, and thrust-bearing front and rear bushings, located between the walls of the chamber and, respectively, the front and rear sides of the impeller.

During operation, the magnet pump takes in the fluid to be transferred through the suction duct and drives it towards the delivery duct through the action of the impeller. During, this action, a pressure drop is created on the front side of the impeller that faces the suction duct; while the impeller and the driven rotor receive a thrust in the direction towards the suction ducts. These actions create a thrust oriented towards the suction duct on the impeller, the thrust being contrasted by the front thrust-bearing bushing.

In particular pressure conditions, the impeller may also translate in the opposite direction, causing the impeller guide bushing to get in touch with the rear thrust-bearing bushing. The pumped liquid also functions to dissipate the heat that is generated due to the friction between the impeller and the thrust-bearing bushings, as well as functions to lubricate the bushings, thereby ensuring proper operation over a long duration of time.

In critical or abnormal operating situations, such as in the case of cavitation (the absence of liquid flow through the pump, or the presence of excessive amounts of entrained gases in the liquid), an excessive vibration phenomenon develops, and because of the presence of gas bubbles in the fluid intake, there is little axial thrust on the impeller and the functions of dissipation of frictional heat and lubrication of the moving parts of the pump are performed by the pumped liquid. In such conditions, as the impeller cannot be maintained any longer in its operating position abutting the front thrust-bearing bushing, it may translate along a supporting spindle and contact the rear thrust-bearing bushing, causing the ensuing generation of more friction heat. The heat thus developed can no longer be dissipated and may lead to severe damage to the pump and even to its seizure and resultant total working failure. Additionally, this type of magnet pump cannot function at idle, that is, in the absence of circulating fluid, for long periods, as that would result in severe damage to the pump for the above-stated reasons.

It is apparent that the aforementioned drawbacks and limitations are unacceptable in magnetic entraining pumps, not only because they may lead to a complete failure of operation of the unit, but especially in the context of their operation in the handling of liquid chemicals, where possible interruptions in operation may prove to be particularly damaging and deleterious to the extent of causing unacceptable risks to both persons and facilities.

Various devices have been proposed to obviate the above drawbacks, however, heretofore none of them has completely solved all of the problems in a satisfactory and economical manner. Thus, for instance, it has been proposed to employ a structure made from thermal insulating, material to enclose the portion of the thrust-bearing bushing most susceptible to frictional heat damage.

This solution, in addition to being expensive, also involves exposure to high temperatures at the contact points, since the insulating characteristics of the material prevent any diffusion of heat, which, even for short periods may lead to the occurrence of so-called "thermal shock".

It has been also proposed to employ thrust-bearing devices constituted by push rods having a rounded end to counteract any axial shifting of the impeller. This solution is also not free from drawbacks since such devices still involve the occurrence of a sliding contact.

SUMMARY OF THE INVENTION

Accordingly, it is an object of the present invention to overcome the foregoing drawbacks. More particularly, it is an object of the present invention to provide a magnetic entraining pump that is capable of operating under any set of conditions, and to prevent the onset of heat or an increase in temperature due to frictional contact, even in extreme or abnormal operating conditions.

In its most general aspects, the present invention allows the achievement of these and still other objects, which will be apparent from the following description, by providing a magnetic entraining pump wherein the impeller is kept in stable equilibrium and its axial position is controlled and self-aligned in both directions. This is achieved by counteracting the axial thrusts and pressures, which the pump impeller is subjected to, by means of a linear magnetic coupling between the impeller and the chamber wherein the impeller is located.

A magnetic entraining pump according to the present invention comprises an inner chamber, preferably cylindrical, provided with a suction duct that extends axially and a delivery duct that extends along the circumference; an impeller located inside of the chamber and having a front portion oriented towards the suction duct, a rear portion oriented towards the opposite direction, and a central support portion; a cup-shaped driving rotor, located outside the chamber and having at least a driving magnet; a driven magnet fixed to the impeller and that faces onto and forms a magnetic coupling with the driving magnet; a supporting spindle that extends axially in the chamber and that supports the impeller in a rotatably and axially movable manner, and, optionally, front and rear thrust-bearing bushings located on the spindle adjacent to the front portion and the rear portion of the impeller, wherein both the chamber and the impeller are provided with at least a magnet and the respective magnets are mutually aligned and arranged such that opposite poles are adjacent to one another, so as to form a linear magnetic coupling when the impeller is in a position of equilibrium between the two front and rear thrust-bearing bushings.

The magnets are arranged such that opposite poles are adjacent to one another, i.e. the North pole of one magnet concatenates with the South pole of another magnet, and vice-versa, so that the opposite poles mutually attract, forming a linear magnetic coupling that keeps the impeller in a position of stable equilibrium. The magnetic coupling opposes any axial force or thrust that tends to alter conditions of equilibrium and perfect alignment of the magnets. Therefore, any axial shifting of the impeller is prevented, as it involves the creation of an opposite return force, and the amount of such a return force increases as the misalignment between adjacent magnets increases.

The thrust-bearing bushings may be of the mechanical type or, especially in the presence of very high axial thrusts, may be, at least partly replaced by thrust-bearing bushings of the magnetic repelling type, which comprise magnets aligned and located in the impeller and the front and/or rear walls of the chamber with like poles opposite to one another, i.e. with the North pole of one magnet opposed to the North pole of another magnet and vice-versa, so as to generate a repelling magnetic force.

The characteristics of the construction and function of the magnetic entraining pump of the present invention are better understood from the following detailed description, wherein reference is made to the figures of the attached drawings, which illustrate a preferred embodiment of the invention, which is presented solely as a non limiting example.

DETAILED DESCRIPTION OF CERTAIN PREFERRED EMBODIMENTS OF THE INVENTION

Figure 2:
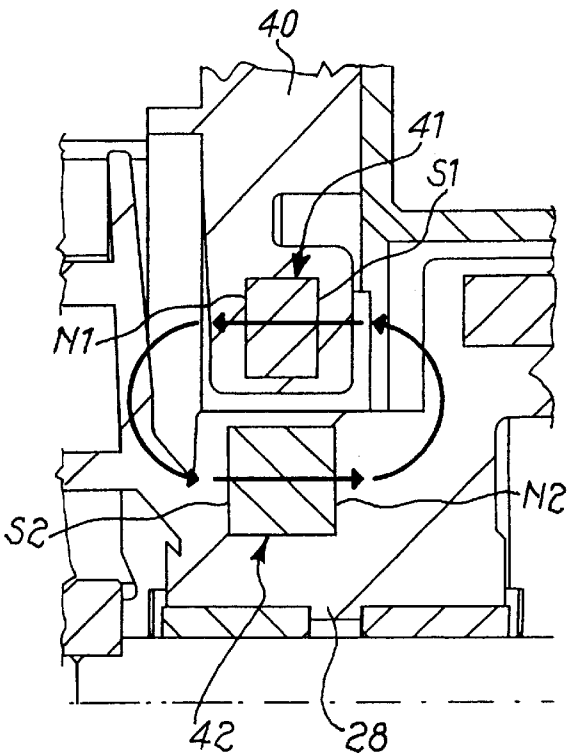
FIG. 2 shows an enlarged schematic view of detail A of FIG. 1, showing the position of magnets for the realization of the linear magnetic coupling.
Figure 1:
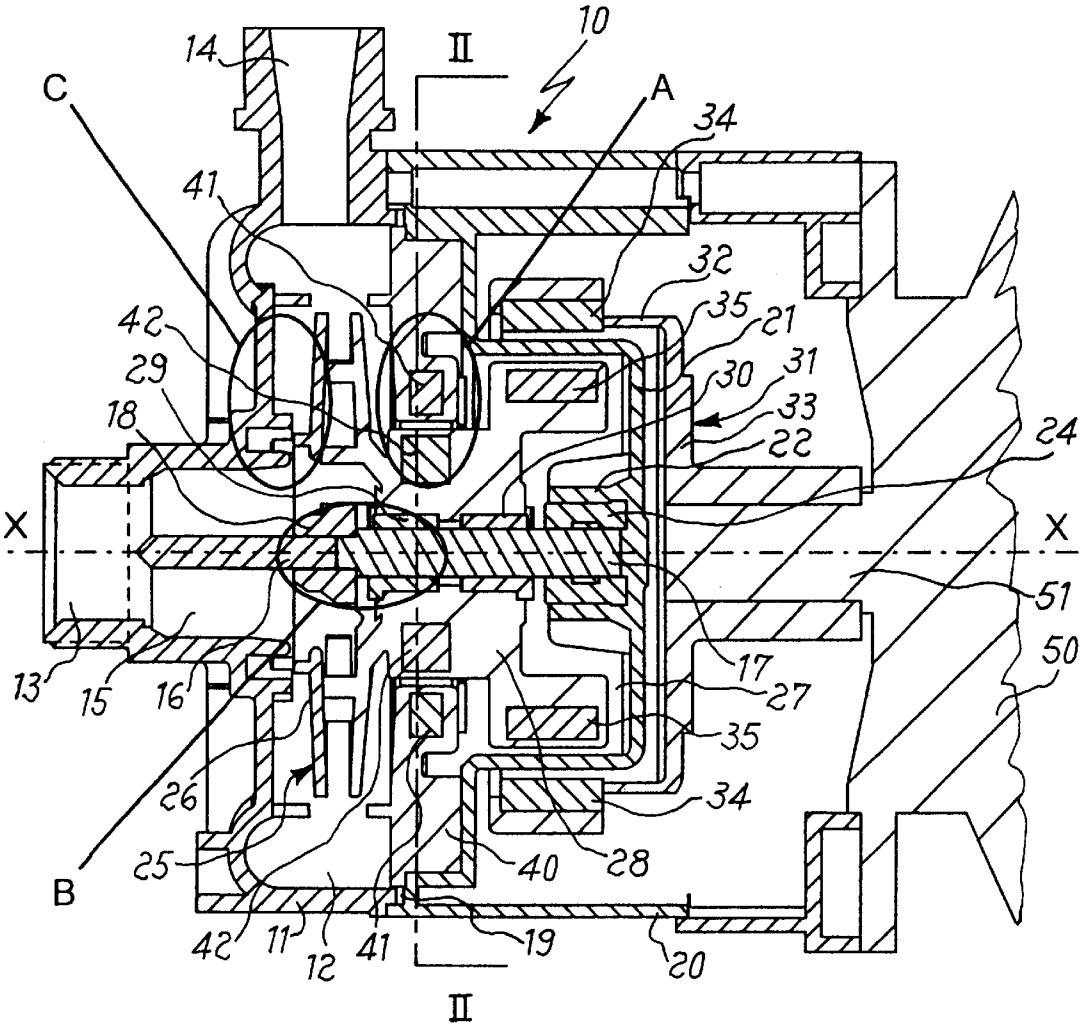
FIG. 1 shows a schematic view of a section of the magnetic entraining pump of the present invention.

FIG. 1 shows the magnetic entraining pump of the present invention, with the pump 10 being shown overall, and coupled to a motor 50, also shown overall.

Pump 10 comprises a substantially cylindrical front portion 11, which defines a part of an inner chamber 12, and is provided with a suction duct 13, which extends in the axial direction along the axis X—X, and a delivery duct 14, which extends along its circumference. The frontal portion 11, at the rear end of suction duct 13 is provided with a conveyor 15, at whose rear end a cylindrical seat 16 is positioned, suitable to house a front thrust-bearing bushing 18.

A substantially cylindrical rear body 20 is coupled and fixed to the front body 11, completing thereby the inner chamber 12. A sealing "O ring" is interposed between the front body 11 and rear body 20 to ensure the sealing of the inner chamber 12.

From the bottom wall 21 of the rear body 20, along axis X—X of the pump, a substantially cylindrical protrusion 22 extends and is provided with a seat suitable to house a rear thrust-bearing bushing 24. Between the front 18 and rear 24 bushings a supporting spindle 17 extends.

An impeller 25 is located inside of chamber 12, the impeller being supported in a rotatably and axially mobile manner by spindle 17 through front 29 and rear 30 guide bushings. The impeller is constituted by an operating front portion 26, oriented towards the suction duct 13, a substantially cylindrical rear entraining portion 27, and a central portion 28.

A cup-shaped driving rotor 31 is located inside of chamber 12 and comprises a first substantially cylindrical wall 32, which embraces the rear portion of chamber 12, and a bottom wall 33 from which a substantially cylindrical portion extends that is coupled to a motor spindle 51 of motor 50.

Magnets 34 are incorporated in the cylindrical portion of the driving rotor 31 and corresponding magnets 35 are incorporated in the rear portion 27 of impeller 25. The magnets 34 and 35 are aligned with each other and are positioned such that their opposite poles are adjacent to one another (i.e., North-South and South-North), so as to constitute an entraining magnetic couple.

A stator element 40 is fixed to the inner surface of the chamber 12 at a position substantially corresponding to the connection zone between the front body 11 and rear body 20. A magnet 41 is incorporated in the stator element 40, and correspondingly, a further magnet 42 is incorporated in the central supporting portion 28 of impeller 25. Both magnets 41 and 42 are mutually aligned and placed such that their opposite poles are adjacent to one another, thereby forming a closed magnetic circuit of a linear magnetic coupling.

Using N1 and S1 to designate the North pole and the South pole, respectively, of one magnet 41, and N2 and S2 to designate the North pole and the South pole, respectively, of the other magnet 42, the North pole N1 of magnet 41 concatenates with the South pole S2 of magnet 42 and consequently the South pole S1 of magnet 41 concatenates with the North pole N2 of magnet 42. In this manner, the opposite poles mutually attract, forming a linear magnetic coupling that keeps the impeller in its initial equilibrium position between the front 18 and rear 24 thrust-bearing bushings, and precluding the occurrence of possible axial thrusts or pressures that would tend to shift the impeller from its equilibrium position.

Any shifting of impeller 25 from its equilibrium position with the aligned magnets 41 and 42 generates a return magnetic force, the magnitude of which is proportional to the magnitude of the shifting.

Figure 3:
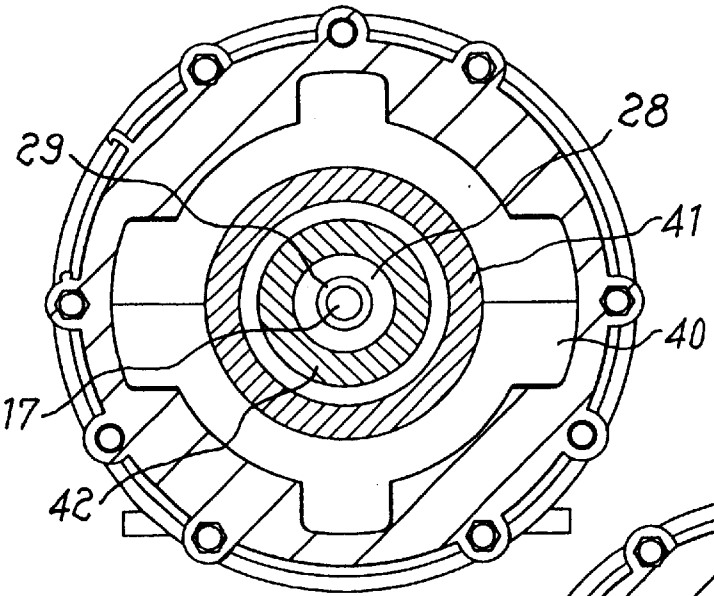
FIG. 3 shows a schematic enlarged view of a section of the pump of FIG. 1 in the direction II—II.

FIG. 3 shows the toroidal ring conformation of magnets 41 and 42.

Figure 4:
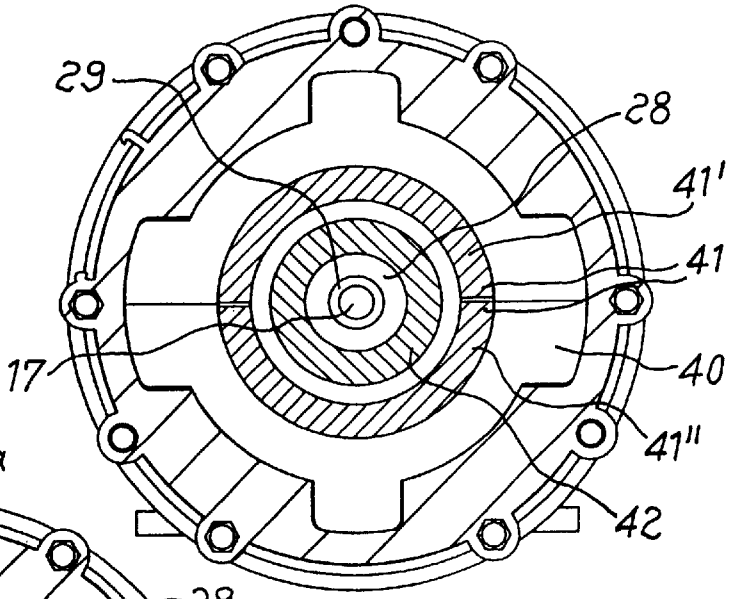
FIG. 4 shows the same schematic enlarged view as in FIG. 3 relating to a first modification of the magnets for the magnetic coupling of FIG. 1.

FIG. 4 shows another embodiment of the magnets. Magnet 41, fixed to stator element 40, is formed by two circular arcs 41' and 41", which are incorporated in the stator element 40, integral with the wall of chamber 12. Both magnets preferably have a quadrangular cross-section.

Figure 5:
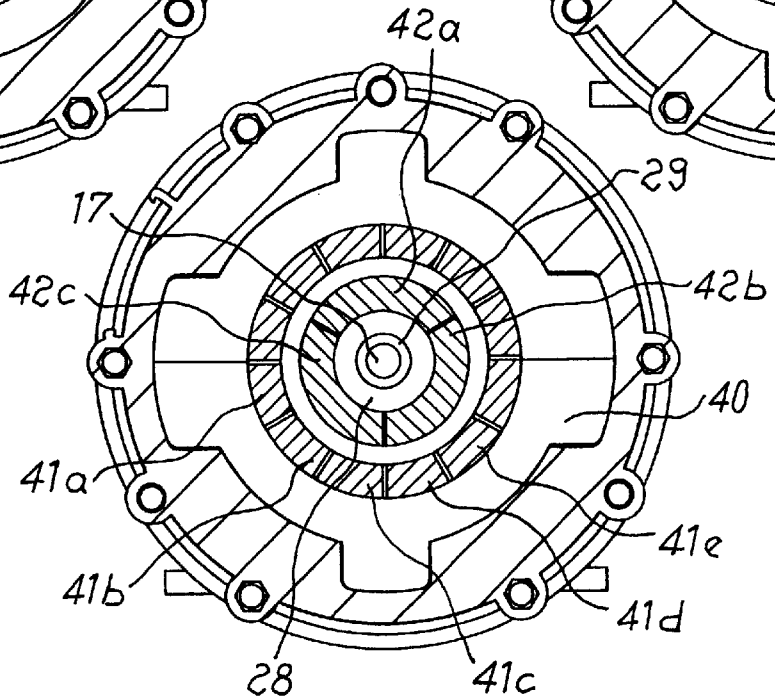
FIG. 5 shows the same schematic enlarged view as in FIG. 3 relating to a second modification of the magnets for the magnetic coupling.

FIG. 5 shows a further embodiment of magnets 41 and 42. Magnets 41 and 42 are shaped as sectors, designated as 41*a*, 41*b*, 41*c*, 41*d*, 41*e*, etc. and 42*a*, 42*b*, 42*c*, etc., respectively, which are incorporated respectively in the stator element 40 and the central support portion 28 of impeller 25.

In one alternative embodiment (not shown), magnetic repelling thrust-bearing bushings comprise two magnets 43 and 44, facing each other and arranged such that like poles of the magnets are adjacent to one another (North-North and South-South). The North pole 43N of magnet 43 faces the North pole 44N of the other magnet 44 and the South pole 43S of the first magnet 43 faces the South pole 44S of the second magnet 44.

Figure 6:
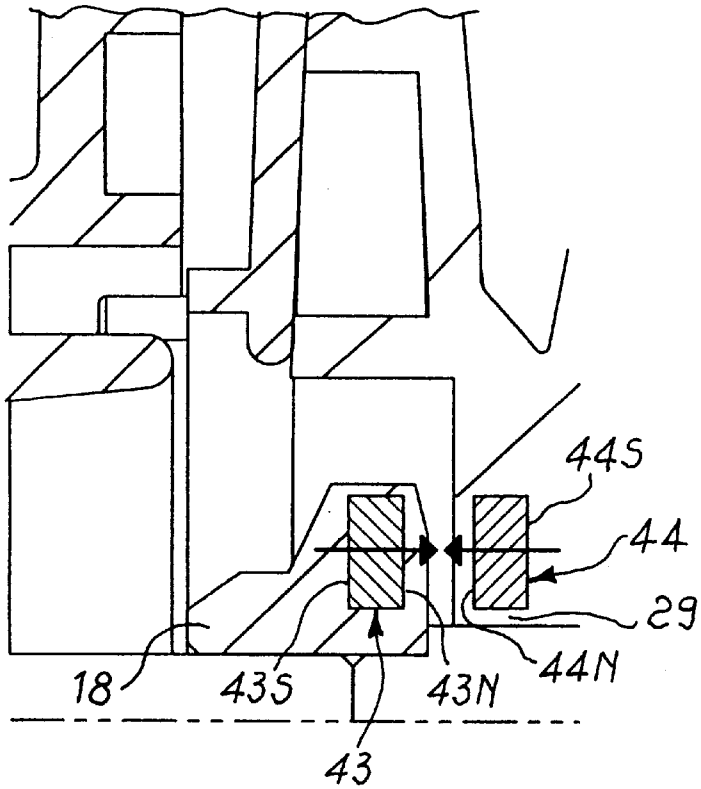
FIG. 6 shows the enlarged schematic view of detail B of FIG. 1 showing, a first positioning solution for the thrust-bearing bushings of the magnetic repulsion type.

In another alternative embodiment illustrated in FIG. 6 with only the North poles 43N, 44N facing each other, magnet 43 may be incorporated in the front 18 and/or rear 24 thrust-bearing bushing, and the other magnet 44 may be incorporated in the front 29 and/or rear 30 guide bushing of impeller 25, as shown in FIG. 6.

Alternatively, magnets 43 and 44 may be used to replace at least one of the front 18 and/or rear 24 thrust-bearing, bushings.

Figure 7:
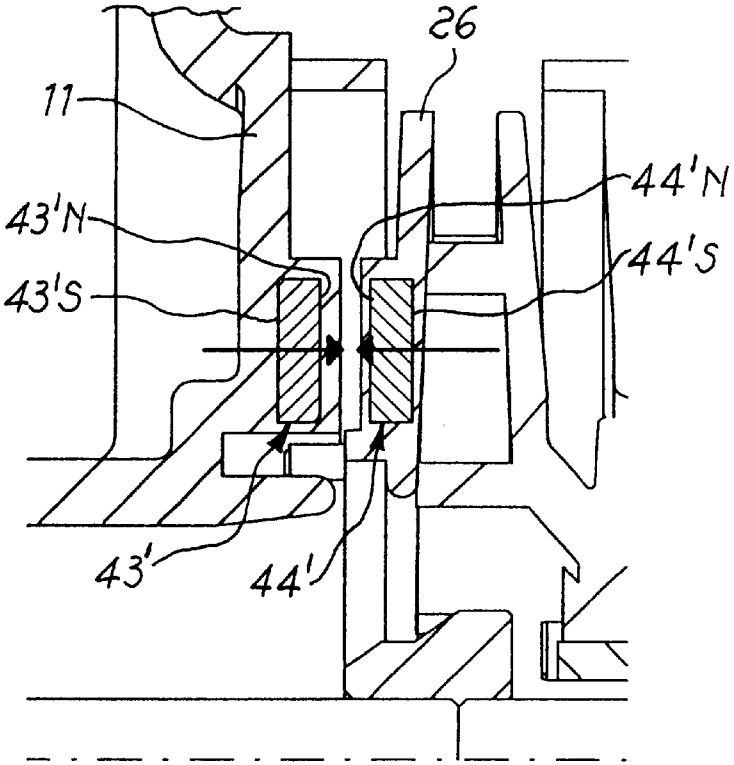
FIG. 7 shows the enlarged schematic view of detail C of FIG. 1 showing, a second positioning solution for the thrust-bearing bushings of the magnetic repulsion type.

Alternatively or additionally, as shown in FIG. 7, further magnets 43' and 44', always arranged such that their like poles are adjacent (North pole 43'N of magnet 43' facing the North pole 44'N of the other magnet 44'), may be incorporated in the wall of the front body 11 and the front operating portion 26 of impeller 25. The arrangement of magnets 43 and 44, and 43' and 44', with like poles adjacent to one another, generates a repelling force when the magnets are moved proximate to one another; and such force pushes the impeller in its equilibrium position between the front 18 and rear 24 thrust-bearing bushings.

In normal pump operation with circulating fluid, the electric motor 50 causes driving rotor 31 to rotate and keeps it rotating though spindle 51. The rotor, in its turn, causes impeller 25 to rotate and keeps it rotating through the magnetic coupling that exists between magnets 34 and 35. With its rotation, impeller 25 conveys, by centrifugal action, the fluid to be transferred through chamber 12 towards the delivery duct 14, transporting it from the delivery duct 13. The pressure difference that exists between chamber 12 and suction duct 13 generates an axial thrust that keeps impeller 25 abutting, with the front surface of guide bushing 29, onto the front thrust-bearing bushing 18.

Impeller 25 may also translate in the opposite direction under special pressure conditions, bringing guide bushing 30 in touch with the rear thrust-bearing bushing 24. Such axial shifts of the impeller are contrasted by the return magnetic force of magnets 41 and 42.

In the case of particular phenomena, such as vibration of the pump or the presence of gas bubbles in the pumped fluid, there is a lack of axial thrust that keeps impeller 25 in its normal operating condition, and in this situation impeller 25 is caused to return towards the central equilibrium position, realigning magnets 41 and 42 and eliminating any contacts between the rotary guide bushings 29 and 30 and the front 18 and rear 19 thrust-bearing bushings.

From the foregoing description, the advantages which the bi-directional axially self-aligning magnet pump of the present invention enables the achievement of are evident. It eliminates and prevents sliding contacts in the axial direction of the impeller on the thrust-bearing bushings, as the magnetic couple opposes any axial shift of the impeller with respect to its equilibrium position.

Any axial shift of the impeller is prevented right from its onset and the return force increases as the misalignment between the magnets increases.

In view of these characteristics, the magnetic traction pump of the present invention is capable of functioning even in the absence of a pumpable liquid, and will continue to operate without any damage to the pump itself even in the face of abnormal and/or critical operating conditions as those described.

Furthermore, the magnetic traction pump of the present invention is particularly simple from the point of view of construction and may be produced at contained manufacturing costs. Due to the operating characteristics of the pump, it may be employed in a wide variety of applications having very different requirements, with a high degree of successful operation under any conditions, even abnormal ones, that may occur.

While this invention has been described with reference to a single specific preferred embodiment thereof, which has been provided solely by way of illustration and example, various alternatives and variants that are within the scope of the invention, which is defined by the appended set of claims, will be obvious to those persons of ordinary skill in the art, in light of the above description.

What is claimed is:

1. A magnet pump with bi-directional axial self-alignment comprising: a cylindrical inner chamber (12) provided with an axially extending suction duct (13) and a delivery duct (14) that extends along a circumference of the chamber; an impeller (25), located inside the chamber (12) and having a front portion (26) facing the suction duct (13), a rear portion (27) facing in an opposite direction to the suction duct, and a central support portion (28); a cup-shaped driving rotor (31) located outside the chamber (12) and having at least a driving magnet (34), and a driven magnet (35), which is incorporated in impeller (25) and faces on and forms a magnetic coupling together with the driving magnet (34); a supporting spindle (17) that extends axially in chamber (12) and that supports the impeller (25) in a rotatably and axially movable manner; and front (18) and rear (24) thrust-bearings bushings located on the spindle (17), proximate to the front portion (26) and the rear portion (27) of impeller (25), such that the impeller (25) is kept in stable axial and rotational equilibrium and its axial position on the spindle is maintained, controlled and self-aligned in both a front and a rear pump directions by means of a linear magnetic coupling between the impeller (25) and the chamber (12) in which the impeller is positioned, wherein the magnetic coupling is formed by means of two magnets (41, 42) incorporated respectively in the wall of chamber (12) and the central portion (28) of the impeller (25), the magnets (41, 42) being mutually aligned and arranged such that opposite poles of the magnets are adjacent to one another (North-South and South-North), so as to form a close magnetic circuit.

2. The magnet pump according to claim 1, wherein the chamber (12) is formed by a front body (11) and a rear body (20) sealed with each other, and an internal surface of the chamber, in a connection zone between the two bodies (11, 20) is provided with a stator element (40) wherein there is incorporated on magnet (41) forming the linear magnetic coupling.

3. The magnet pump according to claim 2, wherein the magnets (41, 42) are shaped as toroidal rings.

4. The magnet pump according to claim 2, wherein at least one of the magnets (41, 42) is shaped as an arc of circle (41', 41").

5. The magnet pump according to claim 2, wherein at least one of the magnets (41, 42) is shaped so as to have a plurality of sectors (41*a*, 41*b*, 41*c*, 41*d*; 42*a*, 42*b*, 42*c*, 42*d*).

6. The magnet pump according to claim 1, wherein at least one of the thrust-bearing bushings (18, 24) is of a magnetic repelling type and includes two magnets (43, 44), facing each other and arranged such that like poles of the magnets are adjacent to one another (North-North and South-South).

7. The magnet pump according to claim 6, wherein one of the magnets (43, 44) is incorporated in the thrust-bearing bushings (18, 24) and the other magnet (43, 44) is incorporated in the guide bushings (29, 30) of the impeller.

8. The magnet pump according to claim 7, further comprising at least one further magnetic repelling thrust-bearing bushing including two magnets (43', 44'), facing each other and arranged such that like poles of the magnets are adjacent to one another (North-North and South-South), with one magnet (43') being incorporated in a wall of the front body (11) and the other magnet (44') being incorporated in an operating front portion of the impeller (25).

* * * * *